US008336431B2

(12) United States Patent
Fassbind

(10) Patent No.: US 8,336,431 B2
(45) Date of Patent: Dec. 25, 2012

(54) METHOD FOR TRIMMING MULTIPLE EDGES OF A PRINT PRODUCT

(75) Inventor: Adrian Fassbind, Winterthur ZH (CH)

(73) Assignee: Mueller Martini Holding AG, Hergiswil (CH)

( * ) Notice: Subject to any disclaimer, the term of this patent is extended or adjusted under 35 U.S.C. 154(b) by 881 days.

(21) Appl. No.: 11/252,253

(22) Filed: Oct. 18, 2005

(65) Prior Publication Data

US 2006/0081100 A1 Apr. 20, 2006

(30) Foreign Application Priority Data

Oct. 18, 2004 (EP) ..... 04405649

(51) Int. Cl.
*B26D 1/00* (2006.01)
*B26D 3/00* (2006.01)
*B26D 5/20* (2006.01)

(52) U.S. Cl. ..... 83/13; 83/234; 83/934

(58) Field of Classification Search ..... 83/26, 39, 83/76, 234, 934, 466, 206, 255, 214, 546, 83/13
See application file for complete search history.

(56) References Cited

U.S. PATENT DOCUMENTS

| | | | | |
|---|---|---|---|---|
| 3,424,044 | A * | 1/1969 | Jardins James Des et al. | 83/255 |
| 3,528,332 | A * | 9/1970 | Jardins James Des et al. | 83/214 |
| 3,722,336 | A * | 3/1973 | Sarring | 83/63 |
| 3,981,212 | A | 9/1976 | McCain et al. | |
| 4,505,173 | A * | 3/1985 | Hartlage | 83/112 |
| 4,653,399 | A * | 3/1987 | Kuehfuss | 101/485 |
| 4,809,754 | A * | 3/1989 | Barnes | 144/392 |
| 6,382,062 | B1 * | 5/2002 | Smith | 83/74 |
| 6,484,615 | B2 * | 11/2002 | Lindee | 83/596 |
| 6,520,058 | B2 * | 2/2003 | Nakajima et al. | 83/206 |
| 7,077,042 | B2 * | 7/2006 | Nogawa et al. | 83/466 |
| 2003/0079584 | A1 | 5/2003 | Cote et al. | |
| 2004/0112195 | A1 * | 6/2004 | Lorenzi | 83/546 |

FOREIGN PATENT DOCUMENTS

| | | |
|---|---|---|
| DE | 30 11 090 | 10/1981 |
| DE | 37 13 905 | 11/1987 |

(Continued)

OTHER PUBLICATIONS

Partial English translation of Office Action from Japanese Patent Application No. 2005-271511, mailed on Jun. 12, 2012.

*Primary Examiner* — Ghassem Alie
*Assistant Examiner* — Bharat C Patel
(74) *Attorney, Agent, or Firm* — Venable LLP; Robert Kinberg; Steven J. Schwarz

(57) ABSTRACT

A method for trimming multiple edges of a print product over the course of several processing steps of a processing cycle using a trimming apparatus is disclosed. The method includes the processing steps of feeding the print product from a stacking device to a trimming device using a feeding device, pressing the print product onto a trimming table using a pressing die, trimming the print product positioned on the trimming table using knives associated with the trimming device, releasing the pressing die from the trimming table, and removing the trimmed print product from the trimming table. The pressing die and the knives are driven by separate drives that are controlled by a control unit. The steps of feeding, pressing down, and releasing are time-variable, while the step of trimming includes a respectively time-constant knife movement for trimming the print product.

7 Claims, 3 Drawing Sheets

FOREIGN PATENT DOCUMENTS

| | | | |
|---|---|---|---|
| DE | 42 06 329 | | 9/1993 |
| EP | 0 485 542 | | 5/1992 |
| EP | 0 740 983 | | 11/1996 |
| EP | 1 152 310 | | 11/2001 |
| JP | 58-192792 | A | 11/1983 |
| JP | 11-104996 | A | 4/1999 |
| JP | 2001-113495 | A | 4/2001 |
| JP | 2002-127077 | A | 5/2002 |

* cited by examiner

METHOD FOR TRIMMING MULTIPLE EDGES OF A PRINT PRODUCT

CROSS-REFERENCE TO RELATED APPLICATIONS

This application claims the priority of European Patent Application No. 04405649.7-1262, filed on Oct. 18, 2004, the entire content of which is incorporated herein by reference.

BACKGROUND OF THE INVENTION

The present invention relates to a method and apparatus for trimming multiple edges of a print product over the course of several processing steps of a processing cycle. The trimming apparatus comprises a stacking device for holding the print products, and a feeding device for transporting the print products from the stacking device to a trimming device. The trimming device includes a pressing die for pressing the print products onto the trimming table, and knives for trimming the print products positioned on the trimming table. The pressing die and the knives have separate drives controlled by a control unit. The processing cycle comprises the following processing steps:

- feeding the print products from the stacking device to the trimming device;
- pressing the print products onto the trimming table of the trimming device;
- trimming the print products while they are positioned on the trimming table of the trimming device;
- releasing the pressing die from the trimming table of the trimming device and conveying the print products away from the trimming table.

Three-way trimmers are known which trim the goods (e.g. stacks of brochures, book blocks, or the like) by pressing the goods against trimming bars. Three-way trimmers of this type can trim a stack (e.g., a stack consisting of at least one book and/or book block) completely and on all three sides while remaining in the same position. The clamped-in good to be trimmed is aligned while on a trimming table and is then trimmed along the head, foot and fore edge. Depending on the design of the three-way trimmer, the sequence of the trimming steps can also be reversed.

Also known are three-way trimmers that trim the fore-edge and the head and foot during separate machine cycles or processing steps. In that case, the good being trimmed must be transported between trimming operations from one trimming station to the next, which has a negative affect on the desired trimming quality.

During the trimming operation, a pressing die presses the good against the trimming table to prevent any movement caused by the resulting cutting forces. To maintain a stable geometry for the good to be trimmed during the trimming operation, it must be ensured that any air which may still be trapped inside the freshly bound good can escape prior to the trimming. Air that is still present in the good during the trimming operation is damaging in several aspects. First, the friction value between pages is reduced because the air acts in the manner of, an air cushion, thus causing the pages to shift relative to each other during the trimming operation. Second, the enclosed air may increase the thickness of the good in certain regions, which can increase the spring-deflection of the good during trimming, causing the upper layers of the good to be cut longer. Both effects reduce the trimming quality.

German reference DE 42 06 329 A, for example, discloses a method for trimming a good which makes use of a pressing device comprising a drive for adjusting pressing elements on the basis of a predetermined characteristic while taking into account the lowest structural mass. The lifting movement of the pressing element can be predetermined in dependence on the operational height for the good to be trimmed. Also provided is a unit for selecting the pressing force and the lifting height. The desired values for the pressing force and the lifting height are input by an operator. However, the disclosed device does not solve the problems caused by enclosed air and the associated reduced trimming quality.

A three-way trimmer is also disclosed in reference EP 0 740 983 A. The disclosed device includes two side-trimming knives and one fore-edge trimming knife. The knives are provided with separate drives operated by digitally controlled servomotors or stepping motors. The movement sequences of the knives are synchronized with the aid of a joint control computer. A pressing die is also provided with a separate drive, which has a digitally controlled servomotor or stepping motor, and is synchronized, thereby resulting in a reduction of the mechanical expenditure and the space required for the coupling elements.

Reference DE 30 11 090 A discloses a trimming apparatus with a mechanically operated pressing device, for which the pressing force can be adjusted hydraulically. The pressing device is positioned automatically, based on the height of the previous good to be trimmed.

SUMMARY OF THE INVENTION

It is an object of the present invention to provide a method and apparatus for trimming multiple edges of a print product, which results in a higher trimming quality.

One exemplary embodiment of the present invention relates to a method for trimming multiple edges of a print product over the course of several processing steps of a processing cycle using a trimming apparatus. The method comprises the processing steps of feeding the print product from a stacking device to a trimming device using a feeding device; pressing the print product onto a trimming table using a pressing die; trimming the print product positioned on the trimming table using knives associated with the trimming device; and releasing the pressing die from the trimming table and removing the trimmed print product from the trimming table. The pressing die and the knives are driven by separate drives that are controlled by a control unit. The steps of feeding, pressing down, and releasing are time-variable, while the step of trimming includes a respective knife movement for trimming the print product that is substantially constant in duration.

Another exemplary embodiment of the present invention relates to a trimming apparatus for trimming multiple edges of a print product using a processing cycle. The apparatus comprises a stacking device; a feeding device; a pressing die operated by at least a first drive; a trimming device that operates jointly with the pressing die and includes several knives, the knives being operated by at least a second drive; a measuring device adapted to measure the thickness of the print product; and a control unit connected to the first drive, the second drive, and the measuring device. The processing cycle includes the steps of feeding the print product with the feeding device, pressing down the print product with the pressing die, trimming the print product with the trimming device, and releasing the pressing die from the print product. The control unit divides the processing cycle between the time-constant trimming step of constant duration, and at least one of the feeding, pressing, and releasing steps.

BRIEF DESCRIPTION OF THE DRAWINGS

These and other features and advantages of the invention will be further understood from the following detailed description of the preferred embodiments with reference to the accompanying drawings to which reference is made for all details not expressly mentioned in the text, wherein.

DETAILED DESCRIPTION OF THE INVENTION

Figure 1:
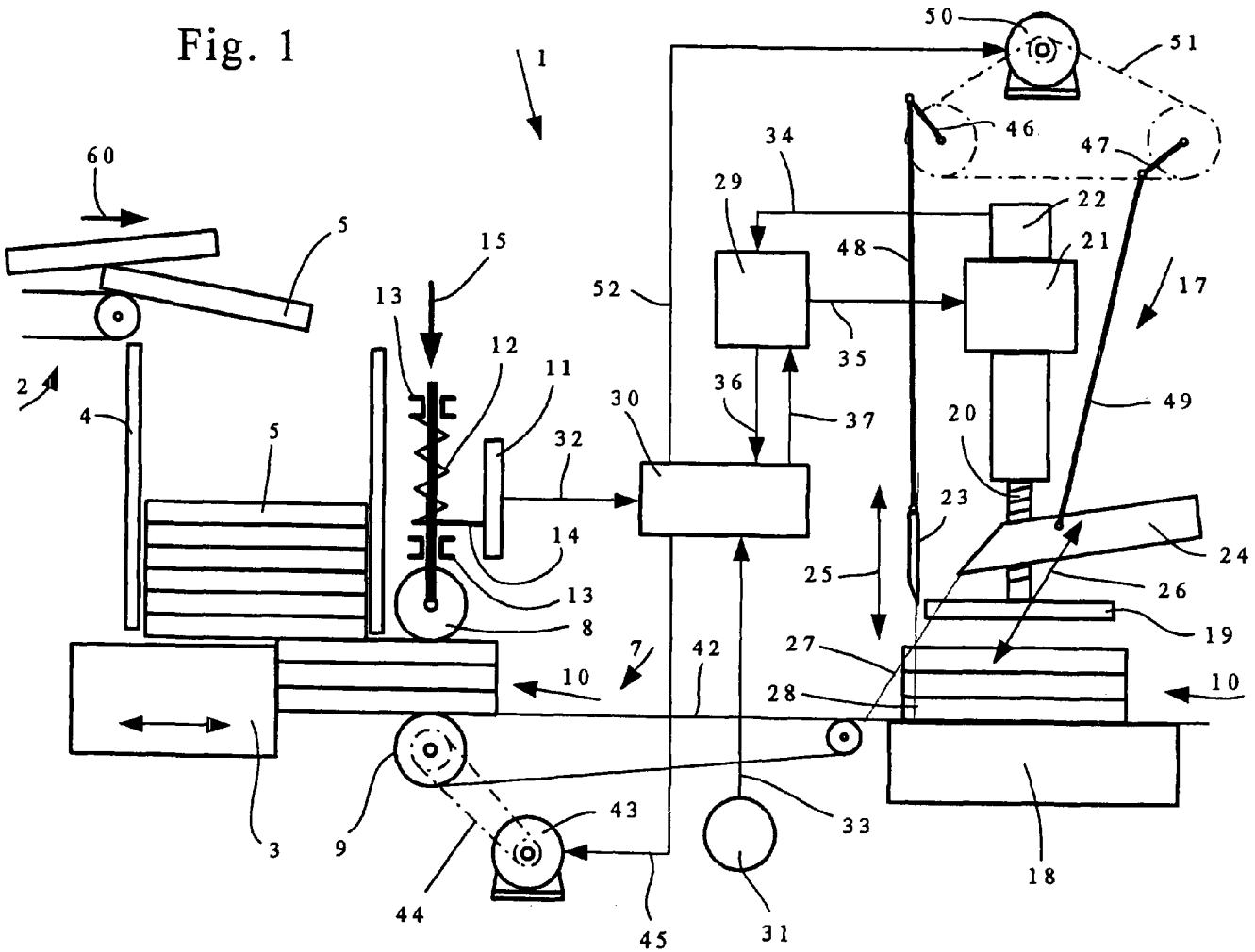
FIG. 1 is a schematic representation of a trimming apparatus according to an exemplary embodiment of the present invention.

FIG. 1 shows an exemplary trimming apparatus 1 for trimming print products, such as books or book blocks, according to the present invention. The trimming apparatus 1 includes a mechanical charging device 2, a feeding device 7, and a trimming device 17. The mechanical charging device 2 comprises a conveying means for supplying the print products 5 in the direction of arrow 60 to a stacking device 4, where a stack of print products 5 is formed. The good 10 to be trimmed (also referred to as the trimming good 10) consists of at least one print product 5. The print products can include, for example, newspapers, catalogues, paperback books, or the like. The thickness of the print products produced during one production run can vary.

A pusher 3 pushes the trimming good 10 from the stacking device 4 onto the feeding device 7. The pusher 3 can have its height adjusted to be equal to or smaller than the minimum height of the trimming good 10. The feeding device 7 includes a lower withdrawing roller 9 and an upper withdrawing roller 8. Both withdrawing rollers 8, 9 can be driven with the aid of a motor 43 and a drive means 44. The motor 43 can be connected via a signal line 45 to a control unit 30. The lower withdrawing roller 9 can be mounted on the machine frame (not shown), while the upper withdrawing roller 8 can be mounted on guides 13 that allow the roller 8 to move vertically up and down against the force of a compression spring 12. Compression spring 12 generates a force in the direction of arrow 15. The vertical position of the upper withdrawing roller 8 can be detected by a measuring device 11 having a connection 14 that moves in response to movement of the roller 8 in the vertical direction. The measuring device 11 can be connected via a signal line 32 to the control unit 30.

Once the trimming good 10 leaves the feeding device 7 in the direction of the trimming device 17, the trimming good 10 is conveyed by means of a conveyor 42 to a trimming table 18 on the trimming device 17. After this, the pusher 3 moves back to its starting position, ready to push out the next trimming good 10.

On the trimming table 18, the trimming good 10 is aligned positively in the longitudinal and transverse directions with the aid of an alignment means (not shown), and is then pressed with a pressing die 19 against the trimming table 18, securing the trimming good 10 in place. The pressing die 19 can be arranged at the lower end of a spindle 20 which is operationally connected to a servomotor 21 that is controlled by a servo-drive 29 via a line 35. The servo-drive 29 can be connected via a signal line 34 to a sensor 22 which detects the position of the pressing die 19, which is moved up and down by turning the spindle 20. The servo-drive 29 can be connected via signal lines 36, 37 to the control unit 30. Once the trimming good 10 is pressed against the trimming table 18 and is thus secured in place, it is subsequently trimmed with a fore-edge knife 23 along the fore edge and with two side knives 24 along the head and foot. The sequence of trimming steps can also be reversed in that the head and foot can be trimmed first and then the fore edge. The fore-edge knife 23 moves vertically up and down in the directions of double arrow 25 while the two side knives 24 move in the direction of double arrow 26 for the trimming operation. The movement paths are shown with dashed lines 27 and 28 in FIG. 1.

The trimming good 10 is preferably trimmed during a single processing cycle. The guided knives 23 and 24 can be driven with the aid of crank drives 46, 47 and via push rods 48, 49. The crank drives 46, 47 in turn are driven by a motor 50 to which they are connected via a drive means 51. The motor 50 can be connected via line 52 to the control unit 30. Servomotors can be used for the motors 43, 50, in which case, one servo-drive is installed between each of the motors 43, 50 and the control unit 30.

Once the good 10 has been trimmed and the pressure removed by lifting the pressing die 19, the good 10 is removed from the trimming table 18 by means of a transporting device that is not shown.

The device for removing the good can be, for example, a pusher, a gripper, or a conveyor-belt system. It is preferable that the next trimming good 10 is fed in at the same time as the previous trimming good 10 is being removed. The machine angle M (e.g., the angular position of the motor 50 and/or crank drives 46, 47 with respect to one full revolution), is preferably determined by a sensor 31 that is connected via a signal line 33 to the control unit 30.

The individual steps of the processing cycle include feeding the trimming good 10 by pushing it out of the stacking device 4 and transferring the good 10 to the trimming device 17, pressing the good 10 onto the trimming table 18 with the pressing die 19, making the fore-edge cut with the fore-edge knife 23 and making the side cuts with the side knives 24, and finally releasing the pressing die 19 from the good 10.

Figure 2:
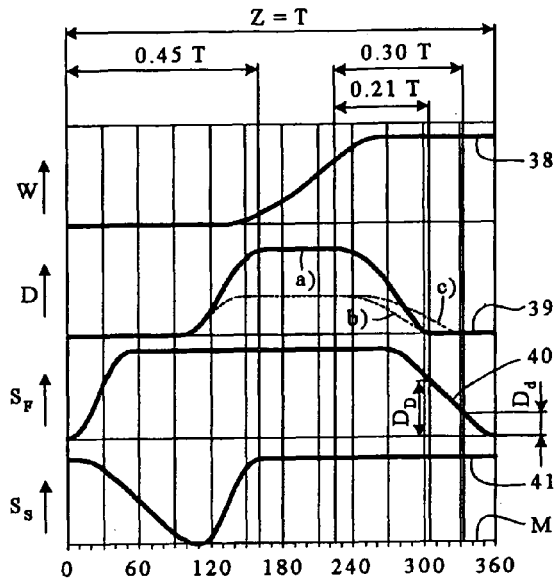
FIG. 2 is a diagram, representing the steps of conveying, pressing, and trimming of the fore-edge and the head/foot, at the maximum possible clocking rate for one processing cycle.

The aforementioned steps are illustrated by curves 38 to 41 in FIG. 2 for a processing cycle with a time interval T, and in dependence on the machine angle M.

The curve 38 represents the trimming good 10 being fed from the stacking device 4 to the trimming table 18, at a machine angle ranging from 130° to 260° along the transport path W. Shortly before the good 10 arrives in the position for trimming on the trimming table 18, the pressing die 19 moves downward by the pressing stroke D, as represented by curve 39, and reaches its lowest position on the trimming good 10 when the machine angle is approximately 300°. The curve 40 illustrates the movement $S_F$ of the fore-edge knife 23, which starts to move in the downward direction at a machine angle of approximately 270° and, shortly after the pressing die has reached its lower end position, starts the trimming of a thick good 10 with thickness $D_D$, after reaching 300°. With a thin trimming good having a thickness of $D_d$, the trimming operation is delayed by approximately 30°, for example, to a machine angle of approximately 330°. The lower end position of the fore-edge knife is reached at 0° from which the fore-edge knife 23 starts the return movement to the upper end position, immediately following the trimming operation. Curve 41 illustrates that the movement of the side knives is analogous to that of the fore-edge knife, but is phase-displaced by 110° (in the present example) in order to prevent a collision of the knives 23 and 24. The total stroke $S_F$ of the fore-edge knife 23 and $S_S$ of the side knives 24 is always the same, regardless of all other parameters.

The curve 39 shows that immediately after trimming with the side knives 24, the pressing force is removed and the trimmed good 10 is conveyed away from the trimming table 18. The next trimming good 10 is supplied at the same time and the above-described processing cycle is repeated. The curve 39(*a*) in FIG. 2, representing the course of the pressing operation, corresponds to pressure applied to the thickest and most fluffy trimming good 10. A smaller stroke as well as a flatter course for the curve 39(*b*) results if the trimming good 10 is less fluffy. The trimming operation for a thin trimming good 10 with thickness $D_d$ starts at approximately 333°. Additional time is thus available for the pressing operation and the course of the pressing curve 39 becomes even flatter, as shown with the curve 39(*c*). The time available for pressing down on the good during the trimming of a thin trimming good 10 as compared to a thick trimming good is consequently increased considerably from 0.21 T to 0.30 T, as shown in FIG. 2. As a result of the longer pressing-down time, more of the air enclosed in the trimming good 10 can escape and a considerably more stable stack results due to higher friction between the individual sheets. As previously mentioned, this has a positive effect on the trimming quality. One example of this is the adaptation of the pressing-down movement to the varied thickness $D_D$ and/or $D_d$ of the trimming good 10. Alternatively or additionally, the time gained can be used, for example, to extend the alignment operation or the time for transporting the trimming good 10.

Figure 3:
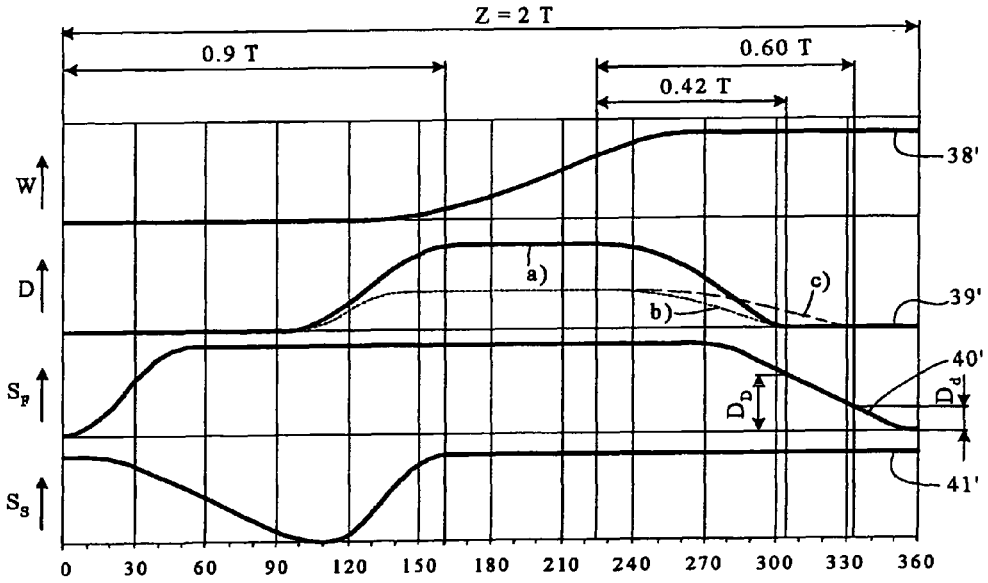
FIG. 3 is a diagram similar to FIG. 2, showing double the cycle time for the processing cycle.
Figure 4:
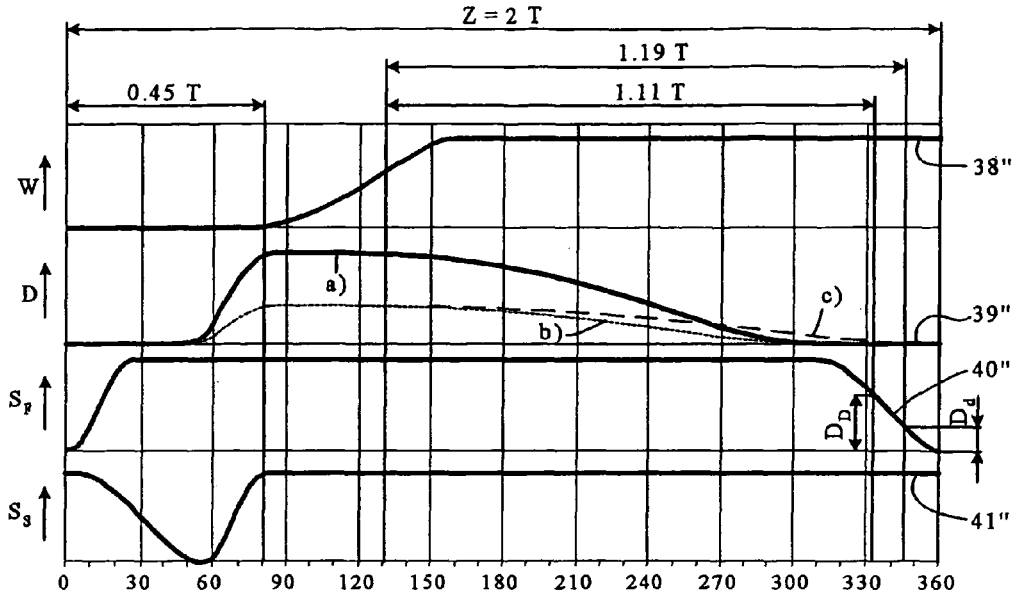
FIG. 4 is diagram similar to FIG. 3, showing an extended pressing time.

Additional advantages are achieved if the trimming operation with the fore-edge knife 23 and the side knives 24 is realized at maximum speed for all operating conditions, which is explained in the following with the aid of FIGS. 3 and 4. If the trimming device 1 operates at half the speed, as illustrated by the diagram in FIG. 3, the cycle time Z is doubled to 2 T. With rigidly connected sequences, all time intervals for the individual steps are thus changed proportional to the cycle time. The corresponding courses for the curves 38', 39', 40' and 41' show the extension of the individual processing steps, for example, a longer transport time as shown with curve 38'. If, as illustrated in FIG. 4, the speed of the trimming operation is not cut in half correspondingly, but is maintained for the trimming operation, the same amount of time as shown in the diagram in FIG. 2 is then required for the trimming operation, meaning 0.45 T. The trimming operation share of a processing cycle is then reduced in favor of the remaining processing steps. As a result, significantly more time is available for the remaining processing steps which are relevant to the quality. This additional time can be distributed over the other processing steps. According to the diagram in FIG. 4, for example, the pressing-down time is 1.19 T, as compared to 0.60 T for a proportional distribution according to the diagram in FIG. 3, which still results in a comparably long pressing-down time of 1.11 T for a trimming good 10 with comparably large thickness $D_D$. As a result of this considerably longer pressing-down time, a correspondingly large amount of air can be squeezed from the trimming good. Since the thickness of a trimming good 10 consisting of several print products 5 can vary over a certain range, it is advantageous if the effective relative thickness $S_R$ for the trimming good 10 is known before each pressing operation, so that the processing steps can be adapted continually and optimally for each processing cycle with the aid of values determined during a preceding calibration operation and by continuously measuring the feeding device 7.

Figure 5:
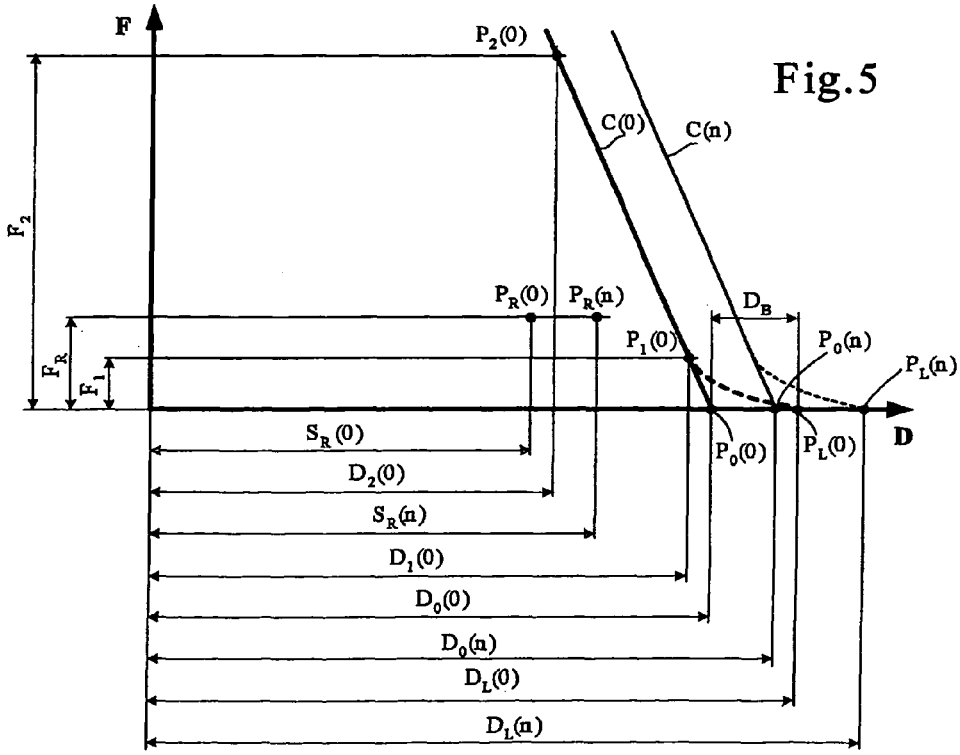
FIG. 5 is a diagram illustrating the fluffiness and dependence of the thickness on the pressing force in order to determine the spring characteristic for the trimming good.

Calibration Procedure:

The trimming device 1 must first be adjusted to the dimensions of the print products and/or the trimming good. This may require, in some circumstances, replacing parts of the device, such as the trimming table 18 or the pressing die 19. The pressing die 19 is then lowered to the trimming table 18 in order to detect the zero point, and the measuring system of the servo drive 29 is calibrated accordingly. This is already standard procedure for machines according to prior art. The new, additional calibration operation is shown with the diagram in FIG. 5 and comprises the following steps:

- Determining the relative thickness of a trimming good 10 by measuring the distance $S_R$ between the withdrawing rollers 8, 9 with the measuring device 11, at the force $F_R$ required for the withdrawing, and storing the measured value $S_R$ (0) in the control unit 30. As shown in FIG. 1, the measuring device 11 is connected to the control unit 30 via signal line 32.
- Conveying the trimming good 10 to the trimming table 18, with the pressing die 19 located in an upper position.
- Lowering the pressing die 19 to the thickness $D_L$ and storing the measured value $D_L(0)$ in the control unit 30, wherein this thickness corresponds to the supplied trimming good 10 before the air is pressed out of it. The first contact between pressing die 19 and trimming good 10 occurs at this thickness. This position can be detected visually by the operator or by means of optoelectronic sensors. The value measured for the position of the pressing die 19 can be polled at the servo drive 29, which is connected via the signal line 34 to the sensor 22 of the servomotor 21.
- Build-up of the pressing-down force $F_2$, which should correspond at least to the pressing-down force required for the production, as well as measuring of the thickness $D_2(0)$.
- Build-up of the pressing-down force $F_1$, which should be considerably smaller than the pressing-down force $F_2$, as well as measuring of the thickness $D_1$ and storing of the measured value $D_1(0)$.

A specific force is built up at the pressing die by generating a corresponding torque at the servomotor 21 with the aid of the servo drive 29. With the aid of points $P_1(0)$ and $P_2(0)$, it is possible to compute the increase in the spring characteristic, using the Formula $C=(F_2-F_1)/(D_2(0)-D_1(0))$, and the point $P_0(0)$. It is only necessary to carry out this calibration on the first trimming good 10. Once the spring characteristic C has been determined, it can be considered a constant because the differences for the thickness $S_R$ within a production run are relatively small. Making the assumption that with all print products 5 of a series, the values $D_0-S_R$, $D_B$ and C of the trimming good 10 are constant, all other points such as $P_0(n)$, $P_1(n)$, $P_2(n)$ and $P_L(n)$ can be computed based on the continuously measured thickness $S_R(n)$.

The thickness $D_L$ of a loose trimming good 10 can be computed, for example, with the following formula:

$$D_L(n)=D_L(0)+(S_R(n)-S_R(0))$$

The drives are coordinated via the control unit 30, which is connected via the lines 37, 45, 52 to the drives or motors. The control unit 30 is supplied via the signal lines 32, 33, 36 with the required measuring values and signals.

It is obvious from the above explanations that a considerable reduction in the press-down speed, above all in the acceleration, is possible by optimizing the pressing stroke, especially for stiff and/or thin print products 5. Independent of the production speed, the trimming device 17 can always operate at the maximum speed which in this case is limited not by the trimming speed, but by the limits predetermined by the mechanics. It is furthermore essential that the cycle time Z, which is longer for a slower machine speed, is available for the transporting, aligning, and pressing down operations, since the same amount of time is always needed for the trimming operation.

It will be understood that the above description of the present invention is susceptible to various modifications, changes and adaptations, and the same are intended to be comprehended within the meaning and range of equivalents of the appended claims.

What is claimed is:

1. A method for trimming multiple edges of a print product over the course of several processing steps of a processing cycle using a trimming apparatus, the method comprising the following processing steps:

feeding the print product from a stacking device to a trimming device using a feeding device;

measuring a thickness of the print product;

pressing the print product onto a trimming table using a pressing die;

trimming the print product positioned on the trimming table using knives associated with the trimming device; and releasing the pressing die from the trimming table and removing the trimmed print product from the trimming table;

wherein the pressing die and the knives are driven by separate drives that are controlled by a control unit;

further wherein the duration of the steps of feeding, pressing down, and releasing is varied based on the measured thickness of the print product, while the step of trimming includes a knife movement that includes a forward stroke and a backward stroke that is substantially constant in duration despite the measured thickness of the print product.

2. The method of claim 1, further comprising the steps of:

measuring values for at least one of fluffiness or spring characteristic for the print product; and determining an upper end position for the pressing die based on the values measured for at least one the fluffiness or the spring characteristic.

3. The method of claim 2, further comprising the step of measuring thickness of the print product at the feeding device.

4. The method of claim 3, further comprising the step of adjusting a starting point for the pressing die based on the measured thickness of the print product.

5. The method of claim 3, further comprising the step of performing a thickness comparison by using a measuring device on the print product.

6. The method of claim 2, further comprising the steps of using at least two press-down forces and taking respective thickness measurements to determine the spring characteristic of the print product.

7. The method of claim 3, wherein the thickness of the print product is measured continuously.

* * * * *